US012728969B2

(12) United States Patent
Hooper et al.

(10) Patent No.: US 12,728,969 B2
(45) Date of Patent: Sep. 8, 2026

(54) HYDROFOIL SLED FOR PAYLOAD TRANSPORT

(71) Applicant: USA as represented by the Secretary of the Navy, San Diego, CA (US)

(72) Inventors: Ralph David Hooper, Lemon Grove, CA (US); William Abbot Chambers, Jamul, CA (US); Christopher Zirkle, Oceanside, CA (US); Taylor Doolittle, San Diego, CA (US); Karl Anders Lindman, Chula Vista, CA (US); Joshua James Erick, San Diego, CA (US); Jeffrey Towns Gilchrist, Cardiff, CA (US); Kelly Krueger, La Mesa, CA (US); Nigel Holman, San Marcos, CA (US)

( * ) Notice: Subject to any disclaimer, the term of this patent is extended or adjusted under 35 U.S.C. 154(b) by 317 days.

(21) Appl. No.: 18/444,316

(22) Filed: Feb. 16, 2024

(65) Prior Publication Data

US 2025/0263157 A1 Aug. 21, 2025

(51) Int. Cl.
*B63G 3/00* (2006.01)
*B63B 1/04* (2006.01)

(52) U.S. Cl.
CPC . *B63G 3/00* (2013.01); *B63B 1/04* (2013.01)

(58) Field of Classification Search
CPC ... B63G 3/00; B63G 1/00; B63G 1/10; B63G 1/04; B63G 1/24; B63B 1/00; B63B 1/10; B63B 1/04; B63B 1/24
See application file for complete search history.

(56) References Cited

U.S. PATENT DOCUMENTS

| | | | | |
|---|---|---|---|---|
| 3,132,619 | A * | 5/1964 | Lopez | B63B 1/285 114/280 |
| 6,840,188 | B1 * | 1/2005 | Witbeck | B63B 27/36 114/259 |
| 10,220,916 | B2 | 3/2019 | Hooper et al. | |
| 2018/0362117 | A1 * | 12/2018 | Hooper | B63B 1/121 |
| 2022/0258841 | A1 | 8/2022 | Hooper et al. | |

FOREIGN PATENT DOCUMENTS

| | | | | |
|---|---|---|---|---|
| EP | 2626295 | A2 * | 8/2013 | B64C 9/22 |
| GB | 2193476 | A * | 2/1988 | B63B 21/66 |

* cited by examiner

*Primary Examiner* — Stephen P Avila
(74) *Attorney, Agent, or Firm* — Naval Information Warfare Center Pacific; Euclid Woo; Kyle Eppele

(57) ABSTRACT

The multiple embodiments of the present invention involve a watercraft payload carrying system for which a payload can be carried and moved in a liquid such as water. The system includes a hydrofoil that when the system is accelerated, the hydrofoil lifts the system and the payload is raised relative to the waterline. In an embodiment the watercraft payload carrying system can have multiple interconnected modules where each module has a hydrofoil and receiver for carrying a payload. In an embodiment, the watercraft payload carrying system is modularly designed where the hydrofoil and receiver are removably attached.

14 Claims, 8 Drawing Sheets

HYDROFOIL SLED FOR PAYLOAD TRANSPORT

FEDERALLY-SPONSORED RESEARCH AND DEVELOPMENT

The United States Government has ownership rights in the invention claimed herein. Licensing and technical inquiries may be directed to the Office of Research and Technical Applications, Naval Information Warfare Center Pacific, Code 72120, San Diego, CA, 92152; voice (619) 553-5118; NIWC_Pacific_T2@us.navy.mil. Reference Navy Case Number 211329.

BACKGROUND OF THE INVENTION

Watercraft, for millennia, have been used to traverse and transport payloads across oceans, seas and rivers. The economics and mission requirements for such watercraft have played a role in their design and implementation. At times, multiple watercraft have worked together to where one watercraft transports another watercraft either by being carried within one's hull or by towing.

It may be both economically or mission requirement beneficial to tow a vehicle or payload as opposed to storing such vehicle in the hull of another. Such benefits may include elimination of loading time and having a larger selection of towing watercraft for the towed vehicle or payload. Existing towing apparatus and methods would benefit from continued improvement. One of a number of improvement goals can include enabling a larger range of towing watercraft options including watercraft with smaller towing power than had been previously contemplated.

SUMMARY

In an embodiment, the present invention relates to a watercraft payload carrying system comprising a first longitudinally extending body, a connector located on a tow side for coupling with a towing watercraft, a first receiver for coupling a payload to the longitudinally extending body and a first hydrofoil coupled to an underside of said longitudinally extending body and having a chord thickness greater on the tow side.

In another embodiment, the present invention relates to a method for transporting a watercraft towable payload comprising immersing a first module and a payload into a liquid, the first module comprising a first longitudinally extending body, a connector located on a tow side for coupling with a towing watercraft, a first receiver for coupling the payload to the longitudinally extending body, and a first hydrofoil coupled to the longitudinally extending body below the longitudinally extending body and the hydrofoil having a chord thickness greater on the tow side, coupling a towing watercraft to the first module, coupling the payload to the first module, accelerating the towing watercraft and raising a majority of the payload above a waterline of the liquid.

In another embodiment, the present invention relates to a method for assembling and disassembling a watercraft payload carrying system comprising removably coupling a first longitudinally extending body to a first hydrofoil, the first hydrofoil having a chord thickness greater on a tow side and decoupling the first longitudinally extending body from the first hydrofoil.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

The disclosed methods and systems below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically. Additionally, the terminology used herein is for the purpose of description and not of limitation. Furthermore, although certain methods are described with reference to steps that are presented herein in a certain order, in many instances, these steps may be performed in any order as may be appreciated by one skilled in the art; the novel method is therefore not limited to the particular arrangement of steps disclosed herein.

It must be noted that as used herein and in the appended claims, the singular forms "a", "an", and "the" include plural references unless the context clearly dictates otherwise. Furthermore, the terms "a" (or "an"), "one or more" and "at least one" can be used interchangeably herein. The terms "comprising", "including", "having" and "constructed from" can also be used interchangeably.

Figure 1:
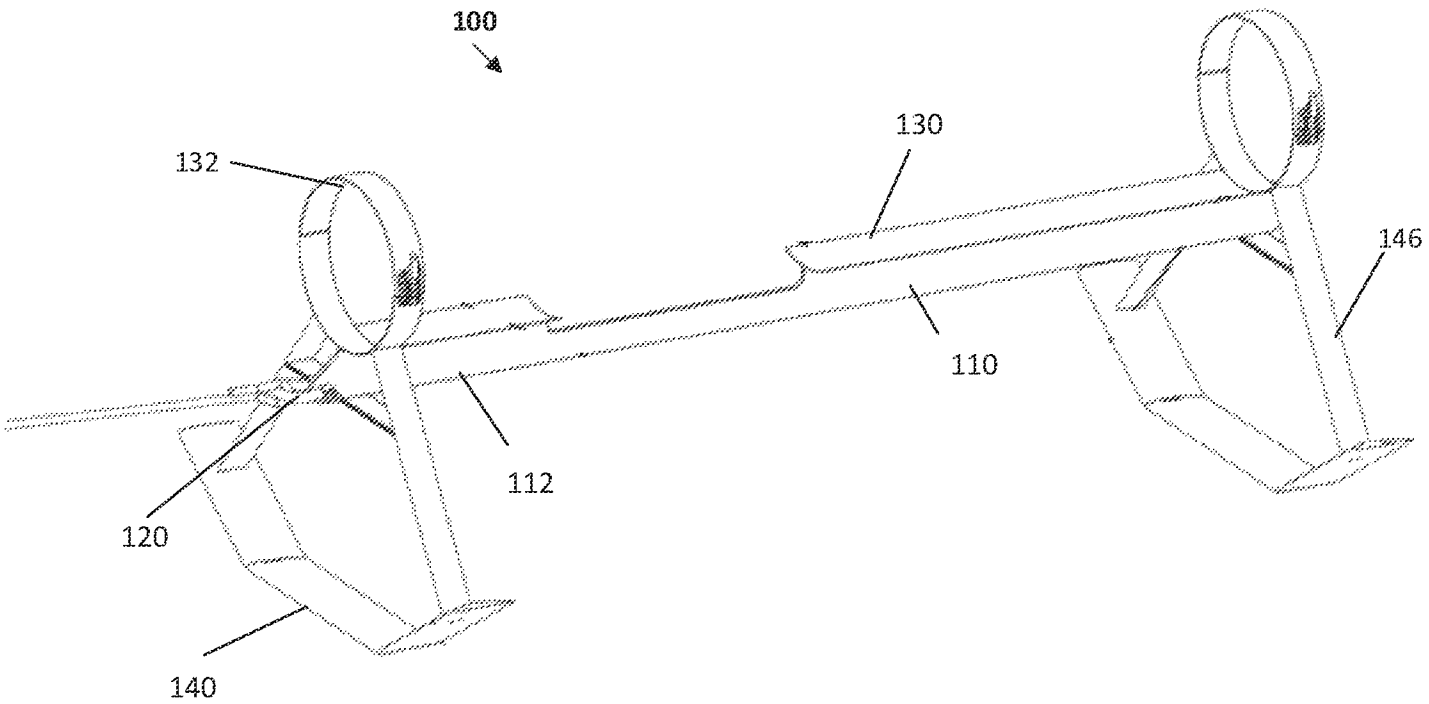
FIG. 1 is a perspective view of a watercraft payload carrying system according to an embodiment of the present disclosure.

Referring to FIG. 1, a watercraft payload carrying system 100 comprising a keel 110, a connector 120, a receiver 130 for coupling a payload to the keel and a forward hydrofoil 140 coupled to an underside 112 of the keel is shown. The keel 110 is, in an embodiment, a longitudinally extending body that can take the form of a beam with a number of possible cross-sections including a plate, T-shaped, I-shaped, U-shaped, tubular and cylindrical. In the embodiment shown in FIG. 1, the keel 110 has a generally T-shaped cross-section where the receiver 130 forms the upper portion of the keel. The tow side or fore side of the keel may be aerodynamically contoured to provide less drag resistance when towed. The connector 120 is located on a tow side for coupling with a towing vehicle and in an embodiment, is an eye latch. The keel 110 may also include an opening to provide a volume for a portion of a payload to lie within when attached to the system 100.

The receiver 130, in an embodiment, is an elongated partial tube or cylinder, having a contoured portion that is complimentary in shape to a portion of the payload. The contoured portion is oval in shape, and more particularly in an embodiment, has a circular cross-section, to complimentarily match a payload having a circular cross-section. The receiver 130 extends along length of a majority of the keel 110 having an opening generally facing away from the top of the keel 110. The contour of the receiver is shaped to optimize a contact surface area with a payload and to reduce gaps in the supporting surface provided by the receiver. In an embodiment, the receiver 130 has an interface for coupling with a platform for carrying a payload. In this embodiment, the receiver 130 may have a flat upper surface with clamps or tie downs that form the interface, that can fasten a platform such as a cargo pallet, to the receiver.

The receiver 130 has a fastener 132 that, in an embodiment, is complimentary in shape to the payload. In this embodiment, the fastener is a clamp. In other embodiments, the fastener can be a tie-down, a full cover or a partial cover. The fastener can be affixed to the receiver or can be separately attached to the receiver and payload when used to fasten the payload to the receiver.

In an embodiment, the receiver 130 is removably coupled or attached to the keel 110. In this embodiment, the receiver 130 forms the top portion of the keel 110 when attached, generally forming a T-shaped cross-section with the top portion forming a complimentary section to an attached payload. When removed, the keel generally forms a plate, if when attached the receiver was attached, the cross-section was T-shaped In another embodiment, the keel generally forms an inverted T-shaped cross-section if when the receiver is attached, the cross-section was I-shaped. Multiple removable keels may comprise the watercraft payload carrying system 100 such that a receiver with a complimentary shape of can be provided for multiple differently-shaped payloads while utilizing the same keel 110 and hydrofoil 140. In an embodiment, the hydrofoil 140 is removably coupled to the keel 110.

The hydrofoil 140 is an aerodynamically-shaped body having a chord thickness greater in one half of the body and having an airfoil-shaped cross-section. The hydrofoil is orientated such that the chord thickness is greater on the tow side. A hydrofoil has a cross-sectional shape such that when a liquid such as water flows over the hydrofoil surface, a pressure differential is created between the upper surface and lower surface creating lift. The lift of hydrofoil cause each hydrofoil to move upward towards the waterline producing force through the structural support 210. The amount of rise of portions of the watercraft payload system 100, including the keel 110 and structural support 210 as well as the payload, reduces the overall drag of the watercraft payload system 100 when towed. Potential damage to the payload is reduced, particularly any sensitive component, as the payload or sensitive component is raised above the waterline, such that the drag or buffeting effects are reduced.

A second hydrofoil 146 may be coupled to the keel 110 and below the keel and aft of hydrofoil 140. Hydrofoil 146 also provides lift to the watercraft payload carrying system 100 and may be optimally positioned in conjunction with the forward hydrofoil 140 to balance lift on the watercraft payload carrying system 100 taking into account the center of gravity. When towed, the amount of rise of the payload above the waterline of the watercraft payload carrying system 100 can be increased by having two or more hydrofoils versus a single hydrofoil. Also, optimized positioning, e.g. accounting for the center of gravity of the payload or the system with the payload attached, of multiple hydrofoils can increase the amount of rise of the payload versus sub-optimized positioning.

In an embodiment, the hydrofoil 140 may have a variable camber device such as a flap, slat, spoiler or aileron to increase or decrease the hydrofoil's lift coefficient. In an embodiment, the variable camber device is set in a generally permanent position prior to a towing. The setting of the variable camber device is done to increase or decrease the lift of the hydrofoil 140 in response to the positioning of the hydrofoil or the weight of the payload. In one example, the hydrofoil 140 may be moved to its limit in creating a lever arm extending from the center of gravity of the watercraft payload carrying system 100 with the payload attached. To further increase the lever arm force generated by the hydrofoil 140, the variable camber device is also adjusted, deflected or deployed, to increase the lift of the hydrofoil 140. The variable camber device may also be adjusted to reduce the risk of the watercraft payload carrying system 100 becoming airborne whereby the lift generated by hydrofoil is reduced for example by a negative or lift-reducing deflection, adjustment or deployment of the variable camber device.

In another embodiment, variable camber system is part of an active system that employs feedback on the positioning of the watercraft payload carrying system 100 to adjust the camber of the hydrofoil 140. The feedback mechanism can comprise a tilt sensor which can sense an undesirable degree of tilt of the watercraft payload carrying system 100 such that one or more hydrofoils, e.g. as shown in FIG. 1, have their lift coefficient adjusted by the variable camber system to produce more or less lift. In an example, the watercraft payload carrying system 100 has a forward hydrofoil 140 and an aft hydrofoil 146. A tilt sensor located on the watercraft payload carrying system 100 detects an undesired upward tilt of the watercraft payload carrying system 100 when being towed. The variable camber system can lower the lift coefficient of the forward hydrofoil 140 or increase the lift coefficient of the aft hydrofoil 146 or some combination of both to achieve a desired level of tilt.

In an embodiment, the variable camber system employs a height sensor as a feedback mechanism. In an embodiment, the height sensor can take the form of a optical sensing device. In another embodiment, the height sensor can take the form of an accelerometer that can measure the trajectory of the watercraft payload carrying system 100. The variable camber system can lower or raise the lift coefficient of the forward hydrofoil 140, the lift coefficient of the aft hydrofoil 146, or some combination of both, to achieve a desired level of height.

Figure 2A:
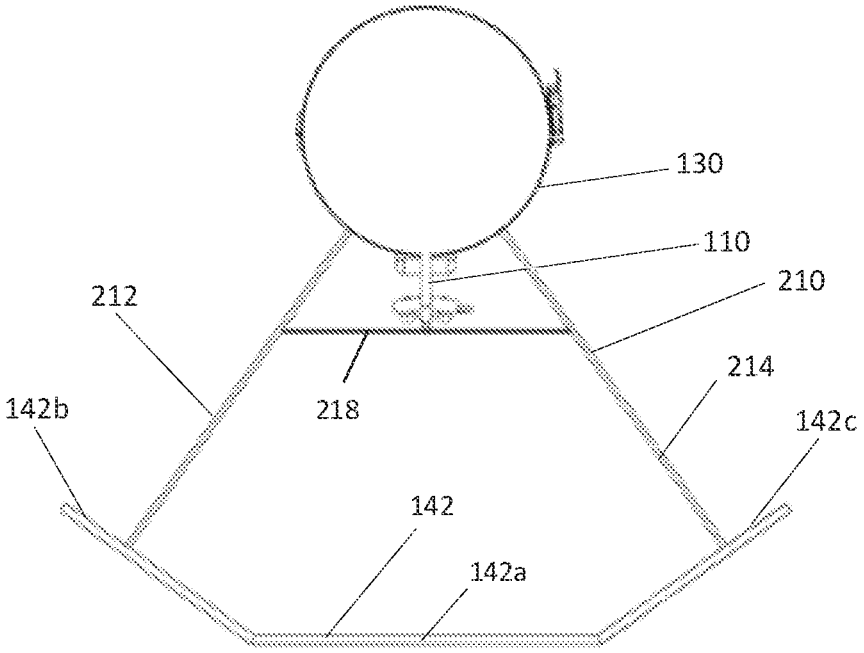
FIG. 2A is a front view of the watercraft payload carrying system in FIG. 1, according to an embodiment of the present disclosure.

Referring to FIG. 2A, an embodiment is shown where the hydrofoil 142 is a surface piercing type. A surface piercing hydrofoil 142, during steady state towing, will have a portion of the hydrofoil 142 lie above the waterline. In this embodiment, the hydrofoil 142 extends laterally and has three elements including a base portion, 142*a* and wing elements 142*b* and 142*c*. Wing elements 142*b* and 142*c* each extend longitudinally, and when extending laterally, are attached at an angle to the base portion 142*a* and extend upward. During steady-state towing, each of wing elements 142*b* and 142*c* will have a portion that will be above the waterline. In another embodiment, a surface piercing hydrofoil has a curved portion extending laterally and upwards towards the waterline and in yet another embodiment a surface piercing hydrofoil is a continuously curving and extends upwards when extending laterally.

A benefit of having a wing element, including wing elements 142*b* and 142*c*, or a wing portion, that extends upwards is that the wing element or wing portion provides a lift self-stabilizing feature. The lift generated by a section wing element or wing portion is greatly reduced as the section rises above the waterline because air is less dense than water. In an example, if the watercraft payload carrying system 100 were to be generating sufficient lift that its trajectory was to make it airborne, i.e. the entirety of hydrofoil 142 were to be above the waterline including base portion 142*a*, the lift would be immediately reduced and the trajectory changed. This would occur because as the hydrofoil 142 was about to rise above the waterline, the wing elements 142*b* and 142*c* would dramatically lose their lift generated as they rose above the waterline and thus the impetus for continuing to rise would change. As such, the entirety of the hydrofoil 142 would not rise above the waterline.

A structural support 210 connects the keel 110 to the hydrofoil 140. In the embodiment of FIG. 2A, the structural support comprises opposed slanted beams 212 and 214 that extend outward from the keel 110 to the hydrofoil 142. Beams 212 and 214 may attach to wings 142*b* and 142*c* or in an embodiment may attach to the base portion 142*a*. A bar 218 may extend between the two slanted beams 212, 214 to provide additional support in at least torsion, tension or compression.

Figure 2B:
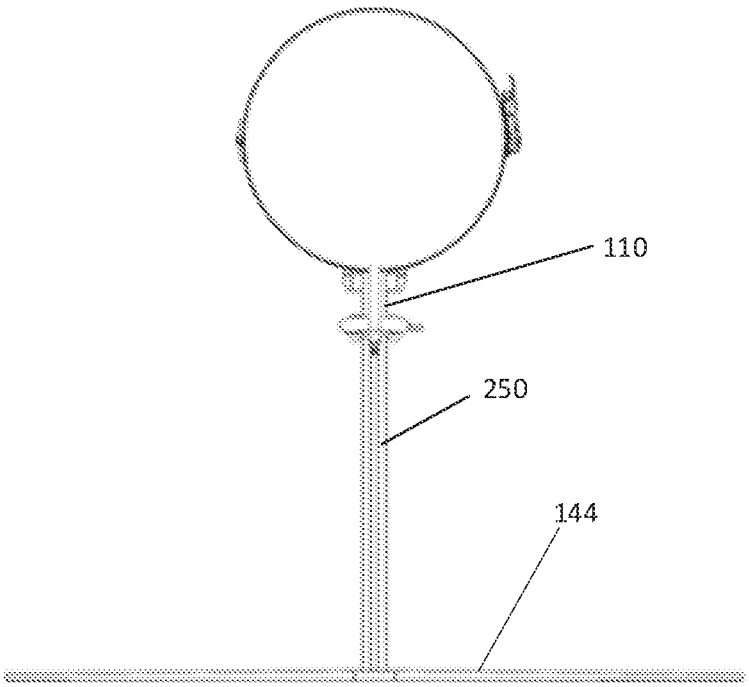
FIG. 2B is a front view of a watercraft payload carrying system according to another embodiment of the present disclosure.

FIG. 2B, illustrates a fully submerged hydrofoil 144 design where during steady state towing, the hydrofoil 144 will be fully submerged. In this embodiment, the fully submerged hydrofoil 144 has an airfoil-shaped cross-section and extends laterally in a generally planar manner. A structural support 250 connects the keel 110 to the hydrofoil 144. In the embodiment of FIG. 2B, the structural support comprises a single column or beam and that extends from the keel 110 to the hydrofoil 144. The column or beam 250 may be comprised of multiple vertical elements either adjoined, integral or non-integral. In a non-integral, non-adjoined embodiment (not shown), multiple vertical elements are coupled indirectly to the keel 110 through a beam that is connected to the keel and transmits loads from the hydrofoil 144 to the keel 110.

Figure 3:
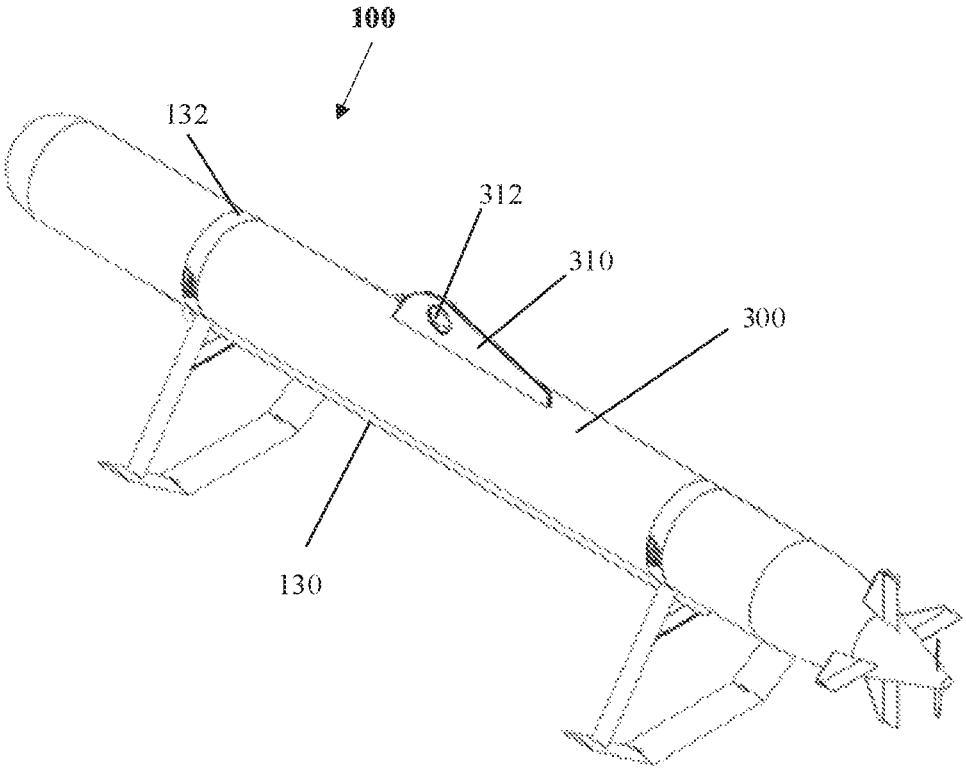
FIG. 3 is a perspective view of a watercraft payload carrying system with a payload according to an embodiment of the present disclosure.

FIG. 3 illustrates a watercraft payload carrying system 100 with a payload 300. In this embodiment, the payload 300 is an underwater vehicle which can take the form of an unmanned underwater vehicle or a torpedo. The payload 300 has an oval, and more particularly circular, cross-section. The receiver 130 is complimentary in shape to the payload 300 such that the receiver 130 has an oval shape as well. The payload 300 may include a structural fin 310 with an eyelet 312 that allows a crane to hook onto the payload 300 and lift the payload or the payload and the watercraft payload carrying system 100 together.

Figure 4A:
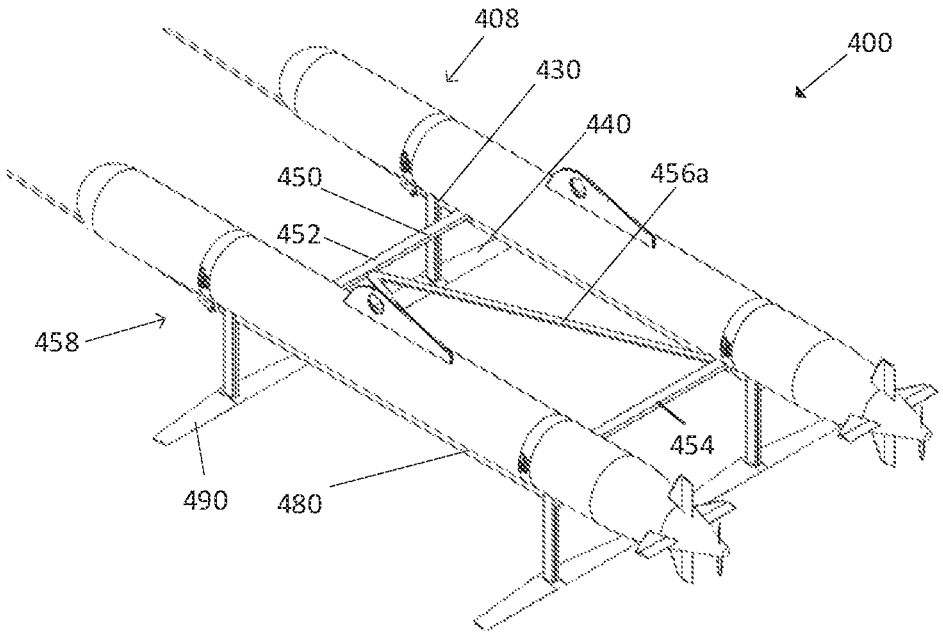
FIG. 4A is a perspective view of a watercraft payload carrying system with multiple modules according to an embodiment of the present disclosure.
Figure 4B:
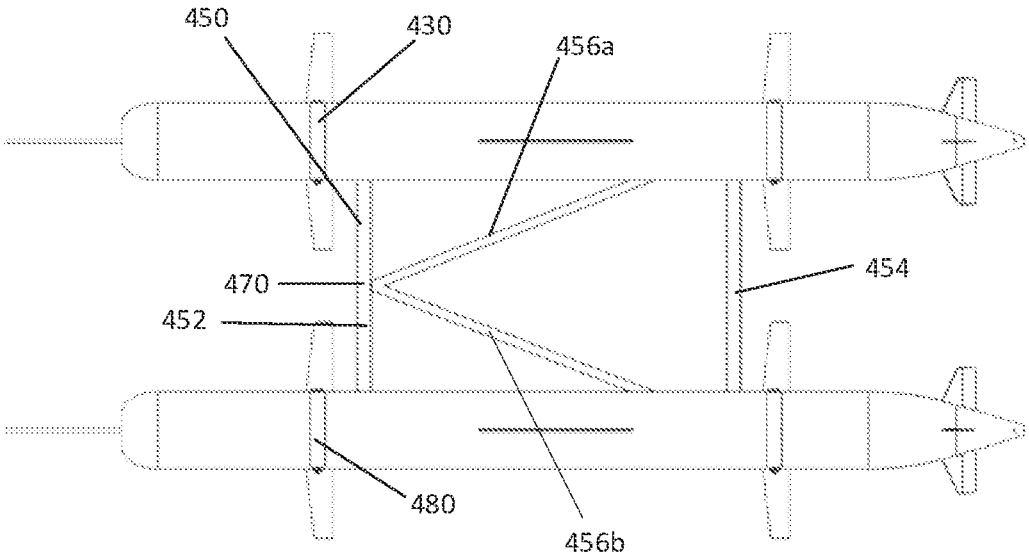
FIG. 4B is a top view of the watercraft payload carrying system with multiple modules in FIG. 4A according to an embodiment of the present disclosure.
Figure 4C:
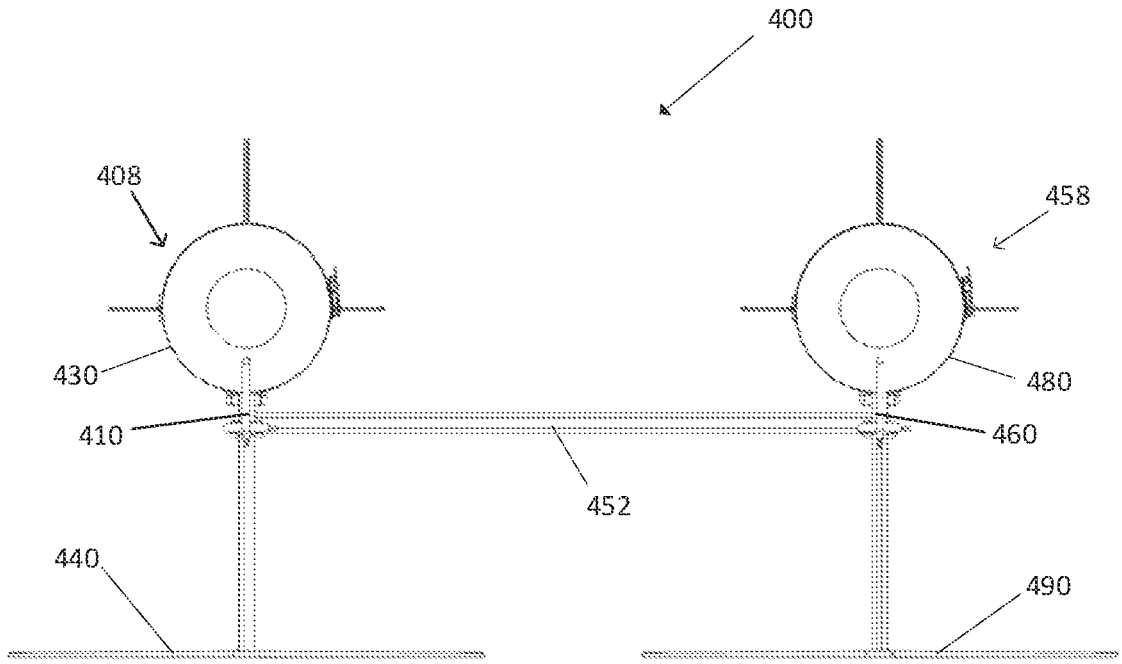
FIG. 4C is a front view of the watercraft payload carrying system with multiple modules in FIG. 4A according to an embodiment of the present disclosure.

FIG. 4A, FIG. 4B and FIG. 4C illustrate and embodiment of a watercraft payload carrying system 400 comprising a first module 408 having a first keel or first longitudinally extending body 410, first receiver 430 and first hydrofoil 440 and a second module 458 having a second keel or second longitudinally extending body 460, second receiver 480 and second hydrofoil 490. A linkage 450 provides an interconnect that couples or connects the first module 408 to the second module 458. In an embodiment, the linkage 450 comprises a beam 452 that is connected at one end to the first keel 410 and at another end to the second keel 460. This connection may be a removable coupling. The linkage 450 may also include a second beam 454 that is connected at one end to the first keel 410 and at another end to the second keel 460 and lies aft of beam 452.

The linkage 450, in an embodiment, further includes structural bracing that includes at least one bar 456*a* that extends from the forward beam 452 to the aft beam 454. Bar 456*a* resists fore and aft loads and resists relative fore aft movement between the first module 408 and the second module 458. The bracing may further include a second bar 456*b* that also extends from the forward beam 452 to the aft beam 454 may also form part of the linkage 450. In an embodiment, one or both of bars 456*a* and 456*b* can have an end that connects to either of keel 410 or 460. In an embodiment, bars 456*a* and 456*b* have a common termination point and in a further embodiment, the common termination point is at or about a midpoint 470 of the forward beam 452.

In an embodiment, one or both of bars 456*a* and 456*b* can have an end that connects to either of keel 410 or 460. As best shown in FIG. 4A, in an embodiment, one or both of bars 456*a* and 456*b* can have an end that connects to either of keel 410 or 460 at a junction where aft beam 454 also connects with either of keel 410 or 460 such that one or both of bars 456*a* and 456*b* are also connected to aft beam 454.

Figure 5A:
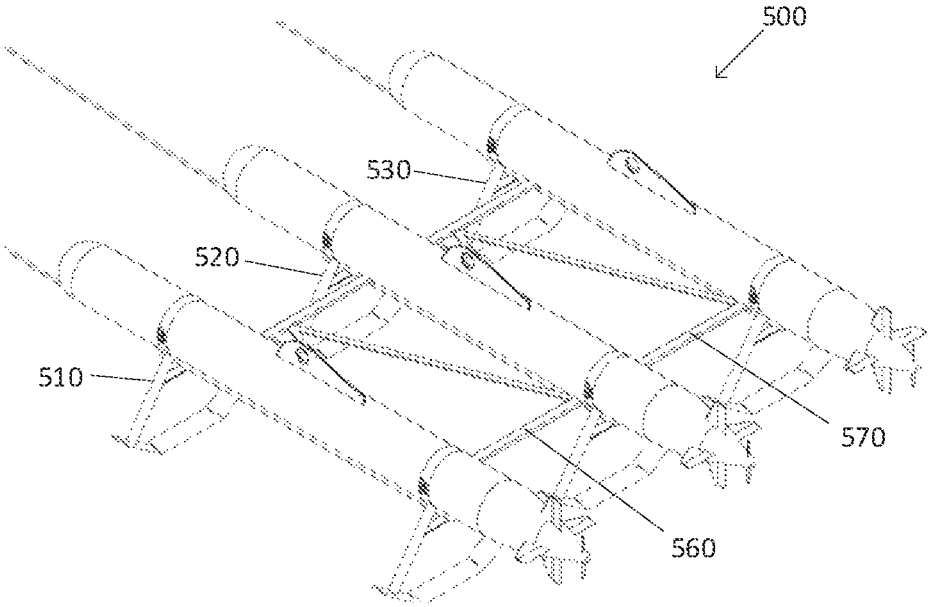
FIG. 5A is a perspective view of another watercraft payload carrying system with multiple modules according to an embodiment of the present disclosure.
Figure 5B:
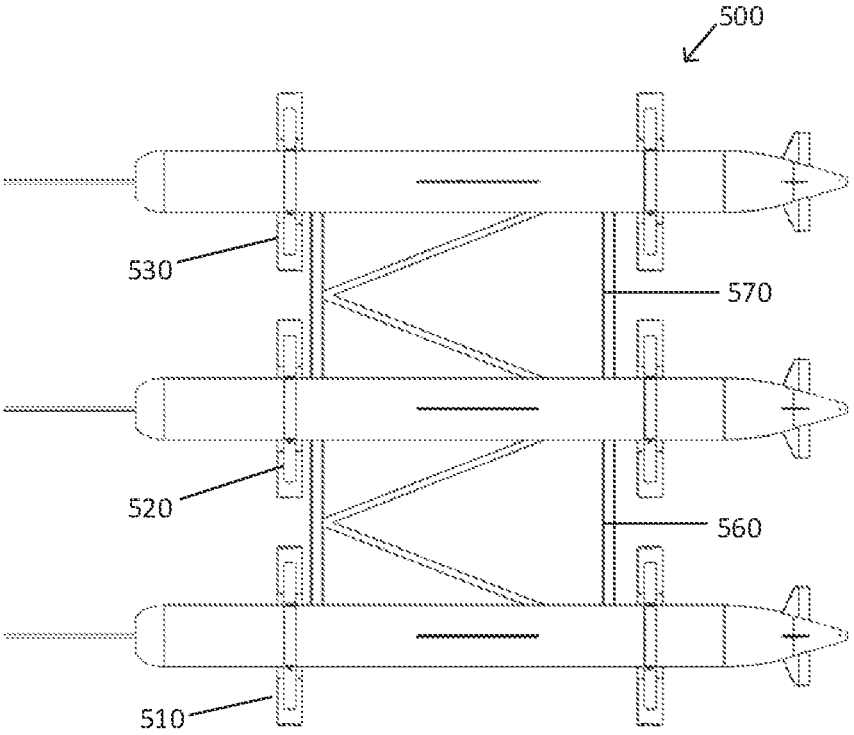
FIG. 5B is a top view of the watercraft payload carrying system with multiple modules in FIG. 5A according to an embodiment of the present disclosure.

FIG. 5A and FIG. 5B illustrate a watercraft payload carrying system 500 having three modules 510, 520, 530. Each module has a keel, receiver and hydrofoil. Linkage 560 couples module 510 to module 520 and linkage 570 couples module 520 to module 530. While module 520 is shown as lying between module 510 and module 530, in an embodiment, the watercraft payload carrying system 500 is modularly designed to interchangeably allow for swappable connections and positions between each module, allowing for multiple configurations for positioning each of the modules relative to each other, when connected.

Figure 6:
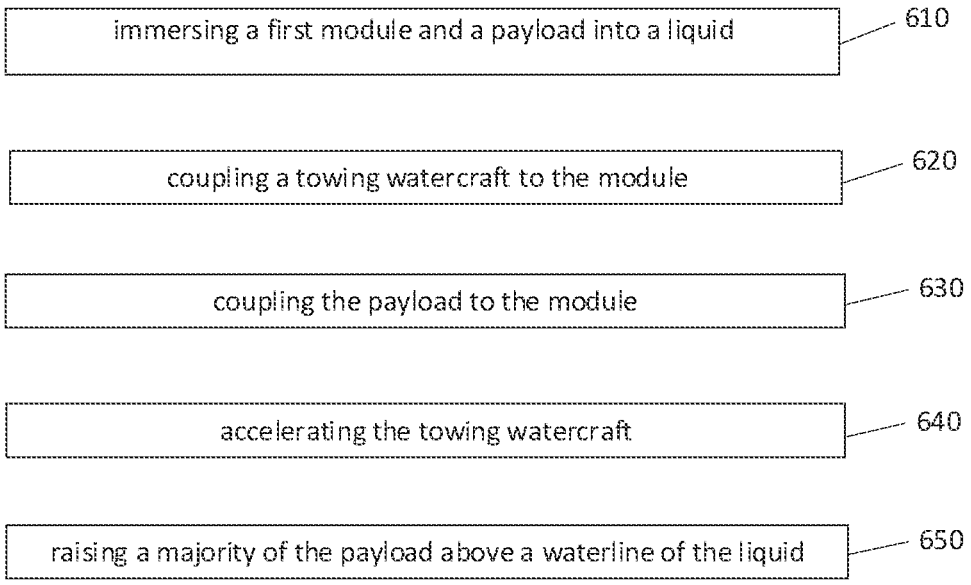
FIG. 6 is a flowchart illustrating the steps for transporting a watercraft towable payload.

Referring to FIG. 6, a method for transporting a watercraft towable payload is shown. The method comprises immersing a first module and a payload into a liquid 610. In an embodiment, the first module comprises a keel or longitudinally extending body, a connector located on a tow side for coupling with a towing watercraft, a receiver for coupling the payload to the keel, and a hydrofoil coupled to the keel below the keel and the hydrofoil having a chord thickness greater on the tow side. The method further comprises coupling a towing watercraft to the module 620, coupling the payload to the module 630, accelerating the towing watercraft 640 and raising a majority of the payload above a waterline of the liquid 650. In an embodiment, the liquid is water. The steps of coupling the payload to the module and coupling a towing watercraft to the module may be interchangeable in terms of whether one is performed before the other or done simultaneously.

The method for transporting a watercraft towable payload illustrated in FIG. 6 may further comprise in the step of immersing a module and a payload into a liquid, immersing a second module and coupling the module to the second module. The coupling of the module to the second module may be done before or after the step of immersing. The method may further comprise determining a center of gravity and positioning the hydrofoil or a second hydrofoil to increase the amount of rise of the payload above the waterline. The method may further comprise coupling a platform to the first module.

Figure 7:
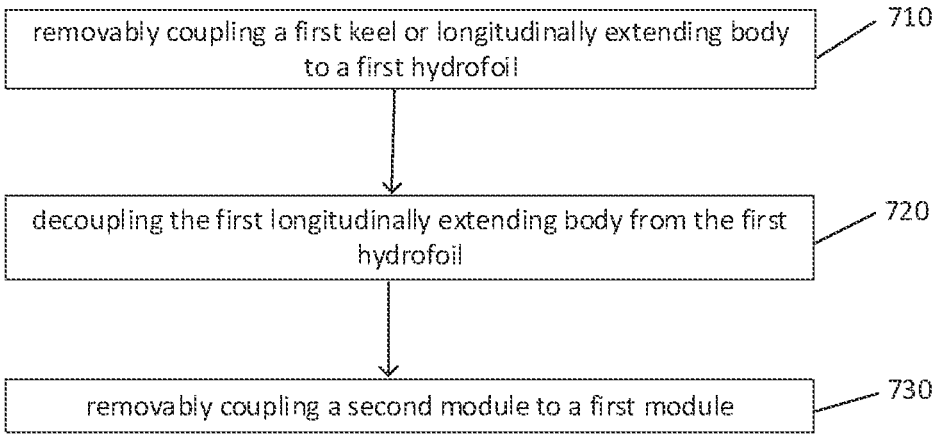
FIG. 7 is a flowchart illustrating the steps for assembling and disassembling a watercraft payload carrying.

Referring to FIG. 7, a method for assembling and disassembling a watercraft payload carrying system comprises removably coupling a first keel or longitudinally extending body to a first hydrofoil, the first hydrofoil having a chord thickness greater on a tow side 710 and decoupling the first longitudinally extending body from the first hydrofoil 720. The method may further comprise removably coupling a second module to a first module, the second module comprising a second keel or longitudinally extending body, second receiver and second hydrofoil and where the first module comprises the first keel or longitudinally extending body, a first receiver and the first hydrofoil 730. The method may further comprise removably coupling a third hydrofoil to the first keel or longitudinally extending body. The method for the step of removably coupling a second module to a first module may comprise coupling a linkage from the first keel or longitudinally extending body to the second keel or longitudinally extending body and decoupling the linkage from the first keel or longitudinally extending body and from the second keel or longitudinally extending body.

In understanding the scope of the present invention, the term "configured" as used herein to describe a component, section or part of a device includes hardware and/or software that is constructed and/or programmed to carry out the desired function. In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Finally, terms of degree such as "substantially", "about" and "approximately" as used herein mean a reasonable amount of deviation of the modified term such that the end result is not significantly changed.

From the above description of the Hydrofoil Sled for Payload Transport, it is manifest that various techniques may be used for implementing the concepts without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that the systems and methods are not limited to the particular embodiments described herein, but is capable of many embodiments without departing from the scope of the claims.

We claim:

1. A watercraft payload carrying system comprising a first longitudinally extending body;

a connector located on a tow side for coupling with a towing watercraft;

a first receiver comprising a contoured portion that is complimentary in shape to a portion of the payload and having an opening facing away from a top of said first longitudinally extending body, said first receiver coupling a payload to said first longitudinally extending body; and a first hydrofoil coupled to an underside of said longitudinally extending body and having a chord thickness greater on the tow side, wherein said first hydrofoil is a surface-piercing hydrofoil having a base portion and at least one wing element extending upward at an angle from the base portion; and a structural support connecting said first longitudinally extending body to said first hydrofoil.

2. The watercraft payload carrying system of claim 1 where the first receiver is removably coupled to said first longitudinally extending body.

3. The watercraft payload carrying system of claim 1 where the first longitudinally extending body, first receiver and first hydrofoil comprise a first module and further including a second module comprising a second longitudinally extending body, second receiver and second hydrofoil and where a linkage couples the first module to the second module.

4. The watercraft payload carrying system of claim 1 further comprising a fourth hydrofoil coupled to said first longitudinally extending body and below said longitudinally extending body and aftward of said first hydrofoil.

5. The watercraft payload carrying system of claim 1 where the receiver has an interface for coupling with a platform for carrying the payload.

6. The watercraft payload carrying system of claim 1 where the first hydrofoil is removably coupled to the first longitudinally extending body.

7. A method for transporting a watercraft towable payload comprising:

immersing a first module and a payload into a liquid, the first module comprising a first longitudinally extending body, a connector located on a tow side for coupling with a towing watercraft, a first receiver comprising a contoured portion that is complimentary in shape to a portion of the payload for coupling the payload to the longitudinally extending body, and a first hydrofoil coupled to said longitudinally extending body below said longitudinally extending body and the hydrofoil having a chord thickness greater on the tow side, wherein said first hydrofoil is a surface-piercing hydrofoil having a base portion and at least one wing element extending upward at an angle from the base portion, and a structural support connecting said first longitudinally extending body to said first hydrofoil;

coupling a towing watercraft to the first module;

coupling the payload to the first module;

accelerating said towing watercraft; and raising a majority of said payload above a waterline of said liquid.

8. The method of claim 7 where the step of immersing a first module and a payload into a liquid further comprises immersing a second module and coupling the first module to the second module.

9. The method of claim 7 further comprising determining a center of gravity and positioning the first hydrofoil or a second hydrofoil to increase the amount of rise of the payload above the waterline.

10. The method of claim 8 where the step of coupling the payload to the first module further comprises coupling a platform to the first module.

11. A method for assembling and disassembling a watercraft payload carrying system comprising:

removably coupling a first longitudinally extending body to a first hydrofoil, said first hydrofoil having a chord thickness greater on a tow side, wherein said first hydrofoil is a surface-piercing hydrofoil having a base portion and at least one wing element extending upward at an angle from the base portion, and a structural support connecting said first longitudinally extending body to said first hydrofoil; and decoupling said first longitudinally extending body from said first hydrofoil.

12. The method for assembling and disassembling a watercraft payload carrying system in claim 11 further comprising removably coupling a second module to a first module, the second module comprising a second longitudinally extending body, second receiver and second hydrofoil and where the first module comprises the first longitudinally extending body, a first receiver and the first hydrofoil.

13. The method for assembling and disassembling a watercraft payload carrying system in claim 11 further comprising removably coupling a third hydrofoil to said first longitudinally extending body.

14. The method for assembling and disassembling a watercraft payload carrying system in claim 12 where the step of removably coupling a second module to a first module comprises coupling a linkage from the first longitudinally extending body to the second longitudinally extending body.

* * * * *